US006550070B2

(12) United States Patent
Wiegand

(10) Patent No.: US 6,550,070 B2
(45) Date of Patent: Apr. 22, 2003

(54) FULL FACE MASK WITH RAPIDLY DETACHABLE STRAP

(75) Inventor: Stephan Wiegand, Krummesse (DE)

(73) Assignee: Dräger Safety AG & Co. KGaA (DE)

( * ) Notice: Subject to any disclaimer, the term of this patent is extended or adjusted under 35 U.S.C. 154(b) by 0 days.

(21) Appl. No.: 10/029,770

(22) Filed: Dec. 21, 2001

(65) Prior Publication Data

US 2002/0095708 A1 Jul. 25, 2002

(30) Foreign Application Priority Data

Jan. 24, 2001 (DE) ..... 101 03 154

(51) Int. Cl.[7] ..... A42B 7/00

(52) U.S. Cl. ..... 2/421; 2/9; 128/207.11; 24/170; 24/191

(58) Field of Search ..... 2/173, 422, 421, 2/424, 9, 6.2; 128/207.11, 207.17; 24/191, 170, 196

(56) References Cited

U.S. PATENT DOCUMENTS 2,935,985 A * 5/1960 Andrews et al. ..... 2/424
4,960,121 A * 10/1990 Nelson et al. ..... 128/207.11
5,181,280 A * 1/1993 Zachry, Jr. ..... 24/191
5,205,021 A * 4/1993 Durand ..... 24/170
5,441,046 A * 8/1995 Starr et al. ..... 128/207.11
6,422,238 B1 * 7/2002 Lithgow ..... 128/207.11

FOREIGN PATENT DOCUMENTS

DE PS 1 174 168 1/1965
DE 42 20 780 C1 9/1993

* cited by examiner

*Primary Examiner*—Rodney M. Lindsey
(74) *Attorney, Agent, or Firm*—McGlew and Tuttle, P.C.

(57) ABSTRACT

A full face mask with a strap, which is fastened to a mask body (15) by clamping action by means of eyes can be removed from the face of the user of the full face mask in a simple manner. Two holding grips are connected to eyes located adjacent to one another. The holding grips are located on a side area (18) of the full face mask (14). A pulling device (19) brings the holding grips (4, 41) into the open position.

7 Claims, 2 Drawing Sheets

FULL FACE MASK WITH RAPIDLY DETACHABLE STRAP

FIELD OF THE INVENTION

The present invention pertains to a full face mask having a strap, which is adjustably fastened by means of eyes which are connected to the full face mask in such a way that the strap is blocked at the eye by a holding grip by clamping action and the blocking can be abolished in an opened position by raising the holding grip.

BACKGROUND OF THE INVENTION

A full face mask of this type has become known from DE-PS 1174 168. Eyes with holding grips, with which the strap is held by clamping action, are located on individual projections of a rubber-elastic mask body of the full face mask. To detach the strap, the holding grips are raised, and the full face mask can be removed.

The strap is normally connected to the mask body at five fastening points, with eyes with corresponding holding grips being located at the fastening points. One of the fastening points is located on the top side of the mask body, while two other fastening points are arranged symmetrically on the side areas of the mask body. Such a full face mask is shown in DE 42 20 780 C1.

To detach the strap, at least the four holding grips located on the side areas must be raised in order to eliminate the blocking of the strap. This operation is time-consuming, especially if the full face mask must be removed from the face of the full face mask's user in case of danger or in the case of diver's masks for rinsing purposes.

SUMMARY AND OBJECTS OF THE INVENTION

The basic object of the present invention is to improve a full face mask of this type such that it can be rapidly detached from the face of the full face mask's user.

According to the invention a full face mask with a strap is provided, which is adjustably fastened by eyes which are connected to the full face mask in such a way that the strap is blocked at the eye by a holding grip by clamping action and the blocking can be abolished in an opened position by raising the holding grip. Two holding grips of the eyes located adjacent to one another, which holding grips are located in a side area of the full face mask, are connected by a pulling device which brings the holding grips into the open position.

According to another aspect of the invention, a process is provided for detaching a strap, which is located on a full face mask and which is fastened to a side area of the full face mask with at least two holding grips. The strap is blocked at the holding grips by clamping action and the blocking is abolished by raising the holding grips. The process includes the steps of connecting the holding grips to a pulling device and of raising the holding grips with the pulling device to detach the strap.

The advantage of the present invention is essentially that by connecting holding grips located adjacent to one another to a pulling device, the holding grips can be raised simultaneously during the actuation of the pulling device in order to release the strap. If the holding grips located on the side areas of the full face mask are connected to a pulling device each and the user of the full face mask pulls the pull cords with his hands away from the full face mask simultaneously when he would like to remove the full face mask, all four holding grips located on the side areas become detached. The full face mask can thus be lifted off from the face immediately, on the one hand, and also held at the same time, on the other hand, by pulling on the pulling devices. By contrast, a user of a full face mask according to the state of the art must hold the full face mask with one hand and raise all four holding grips on the side areas of the full face mask one after another with the other hand to remove the full face mask in order to release the strap. A pull cord, which is connected by its free ends to the holding grips, is suitable for use as the pulling device.

It is especially advantageous to design the pulling device as an elastomer molding and to injection-mold a reinforcing element with the molding approximately in the middle of the molding. As an alternative, the reinforcing element may also be designed as a sleeve, which is pushed over the elastomer molding. To open the full face mask, the user of the full face mask grips the reinforcing element and abolishes the blocking of the strap by raising the holding grips. For better handling, the reinforcing element may be provided with recessed grips.

The process according to the present invention for detaching a strap located on a full face mask, which is fastened with at least two holding grips on a side area of the full face mask and is blocked by clamping action on the holding grips, comprises the connection of the holding grips to a pulling device and the raising of the holding grips together with the pulling device to detach the strap, the blocking of the strap being abolished by the raising of the holding grips.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
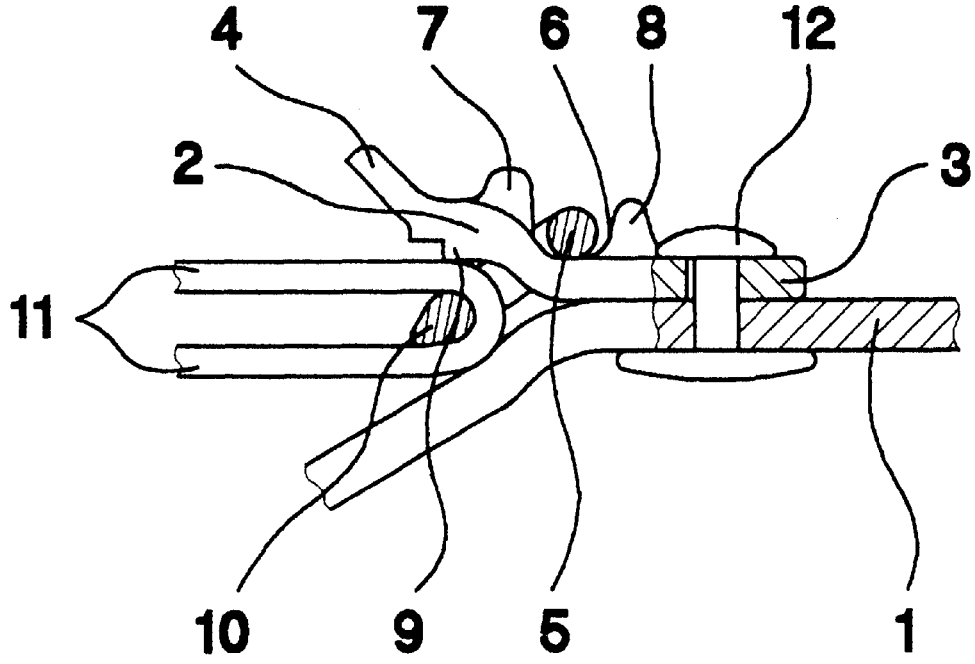
FIG. 1 is a partial sectional view of an eye with a clamping device for a strap.

Referring to the drawings in particular, a lever 2 is fastened to a projection 1 of a mask body, not shown more specifically in FIG. 1. The lever 2 comprises a fastening part 3 for connection to the projection 1, on the one hand, and a holding grip 4 carrying an eye 5, on the other hand. On a side of the lever 2 facing away from the projection 1, the lever 2 is provided with a recess 6, in which the eye 5 is located. Pins 7, 8 on both sides of the recess 6 fix the eye 5 in the recess 6. A strap 11 is led around through an eye part 10 of the eye 5 pointing toward the projection 1. On a side directed toward the strap 11, the lever 2 has a barb 9, which is located approximately in the area of the eye part 10 around which the strap 11 is led. With the strap 11 tightened, the eye part 10 and consequently also the strap 11 are pressed against the barb 9, so that the strap 11 is held by clamping action. A button 12 is used to fasten the lever 2 on the projection 1.

Figure 2:
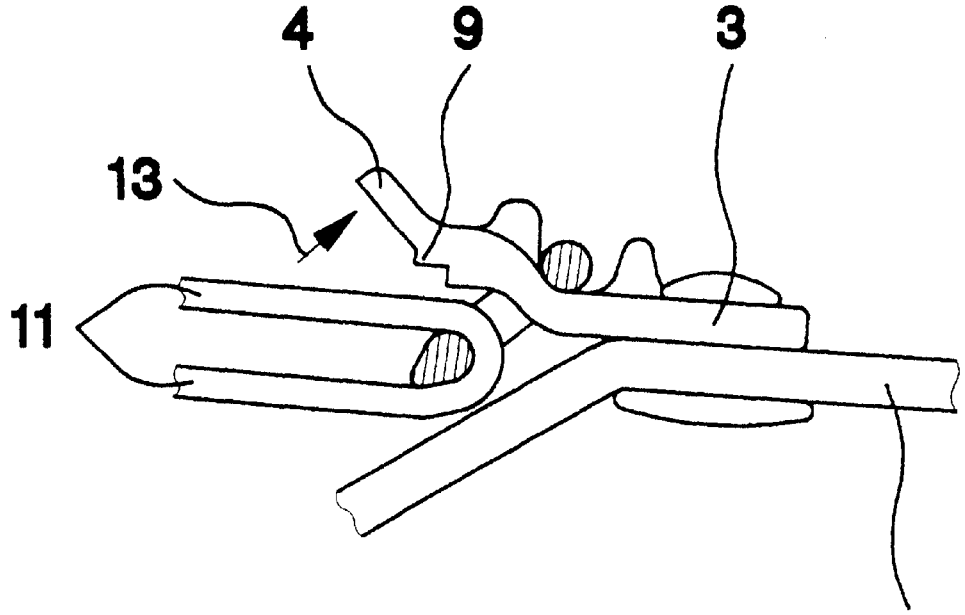
FIG. 2 is a partial sectional view of a device according to FIG. 1 in the opened state.

To detach the strap 11, the holding grip 4 of the lever 2 is raised, as is indicated by an arrow 13 in FIG. 2. The clamping action between the barb 9 on the holding grip 4 and the strap 11 is now abolished. Identical components are designated by the same reference numbers as in FIG. 1.

Figure 3:
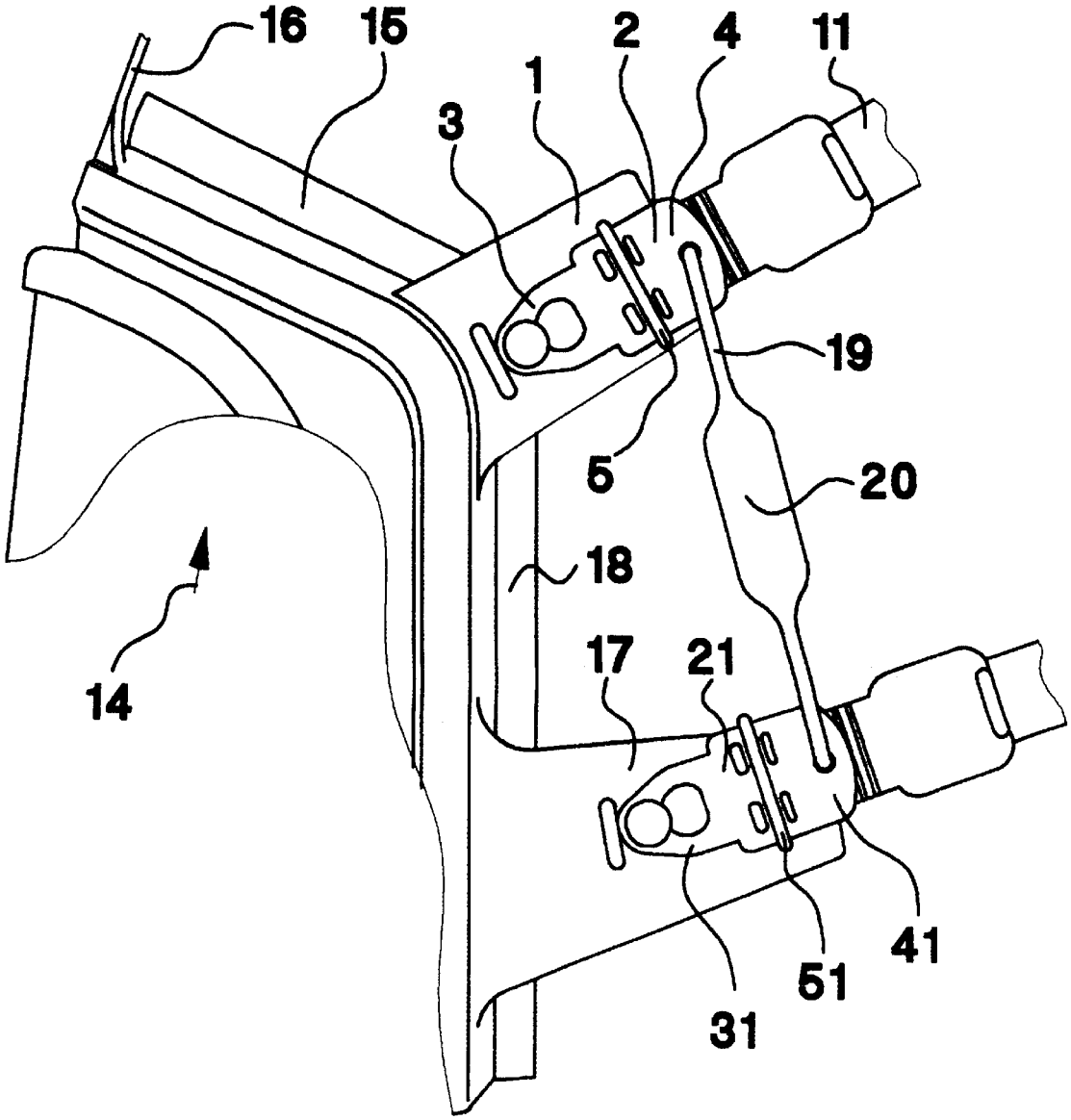
FIG. 3 is a side view showing two eyes arranged adjacent to one another in the side area of a full face mask for fastening a strap.

FIG. 3 shows a detail of a full face mask 14 with a mask body 15 and individual projections 1, 16, 17, to which the strap 11 is fastened. The projections 1, 17 are located on a left side area 18 of the full face mask 14. Since the full face mask 14 has a symmetrical design, two projections are likewise arranged on a right side area, which is not shown in FIG. 3, so that the strap has a total of five fastening points on the mask body 15. The strap 1 is connected to the projections 1, 16, 17 in the same manner by means of eyes and corresponding holding grips. Thus, an eye 51 is located at a lever 21 comprising a fastening part 31 and a holding grip 41 at the projection 17 of the full face mask 14. The holding grips 4, 41 are connected via a pulling element 19, and the pulling element 19 is reinforced by a reinforcing element 20. A corresponding pulling element with a reinforcing element is located on the right side area of the full face mask 14, which is not shown in FIG. 3.

The device according to the present invention operates as follows:

After putting on the full face mask 14, the strap 11 is tightened in the known manner. If the full face mask 14 must be detached quickly from the face of the full face mask's user, the user grasps the reinforcing elements 20 with his hands and pulls them forward. The holding grips 4, 41 as well as the holding grips on the opposite side area of the full face mask are now raised and the strap 11 becomes detached. The full face mask is held at the same time by the two reinforcing elements 20 and it can thus be removed from the face of the user of the full face mask.

While specific embodiments of the invention have been shown and described in detail to illustrate the application of the principles of the invention, it will be understood that the invention may be embodied otherwise without departing from such principles.

What is claimed is:

1. A full face mask, comprising:

a strap structure for holding the full face mask to a user, said strap structure including a part having a first holding grip and another part having a second holding grip;

a first eye;

a second eye, said first and second eye being connected to the full face mask such that said strap is blocked at said first eye and second eye by a respective first holding grip and second holding grip by clamping action and the blocking can be abolished in an opened position by raising the respective holding grip, said holding grips and said eyes being located adjacent to one another at a side area of said full face mask; and a pulling device connected to each of said first and second holding grips to bring the holding grips into the open position.

2. A full face mask in accordance with claim 1, wherein the pulling device is an elastomer part.

3. A full face mask in accordance with claim 1, wherein a reinforcing element is connected to said pulling device.

4. A process for detaching a strap located on a full face mask and fastened to a side area of the full face mask with at least two holding grips blocking the strap using the holding grips with a clamping action with removal of the blocking by raising the holding grips the process comprising the steps of:

connecting the holding grips to a pulling device; and raising the holding grips with the pulling device to detach the strap.

5. A full face mask, comprising:

a full face mask mask;

a first mask projection with a first holding grip and another part having a second holding grip;

a first eye connected to a mask strap;

a second eye connected to a mask strap, said first and second eye being connected to said respective first holding grip and second holding grip to be blocked by clamping action with blocking being removed in an opened position by raising the respective holding grip, said holding grips and said eyes being located adjacent to one another at a side area of said full face mask; and a pulling device connected to each of said first and second holding grips to bring the holding grips into the open position.

6. A full face mask in accordance with claim 5, wherein the pulling device is an elastomer part.

7. A full face mask in accordance with claim 5, wherein a reinforcing element is connected to said pulling device.

* * * * *